US009650875B2

(12) United States Patent
Jackson et al.

(10) Patent No.: US 9,650,875 B2
(45) Date of Patent: May 16, 2017

(54) LINER HANGER SETTING TOOL AND METHOD FOR USE OF SAME

(71) Applicant: Halliburton Energy Services, Inc., Houston, TX (US)

(72) Inventors: Alan Tancel Jackson, Frisco, TX (US); Abdolreza Gharesi, Southlake, TX (US); Steven John Cramp, Houston, TX (US); Ryan Thomas Humphrey, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/034,065

(22) PCT Filed: Dec. 5, 2013

(86) PCT No.: PCT/US2013/073220

§ 371 (c)(1),
(2) Date: May 3, 2016

(87) PCT Pub. No.: WO2015/084355

PCT Pub. Date: Jun. 11, 2015

(65) Prior Publication Data

US 2016/0265319 A1 Sep. 15, 2016

(51) Int. Cl.
*E21B 43/10* (2006.01)

(52) U.S. Cl.
CPC ..... *E21B 43/103* (2013.01); *E21B 43/105* (2013.01); *E21B 43/108* (2013.01)

(58) Field of Classification Search
CPC ..... E21B 43/129; E21B 43/1291; E21B 43/1292; E21B 43/1293
USPC ..... 166/206, 207
See application file for complete search history.

(56) References Cited

U.S. PATENT DOCUMENTS

| | | | | |
|---|---|---|---|---|
| 2003/0042028 | A1* | 3/2003 | Lauritzen | E21B 33/1295 166/384 |
| 2003/0047322 | A1 | 3/2003 | Maguire et al. | |
| 2003/0141059 | A1 | 7/2003 | Maulden et al. | |
| 2005/0005668 | A1* | 1/2005 | Duggan | C21D 7/04 72/370.06 |
| 2005/0230123 | A1 | 10/2005 | Waddell et al. | |
| 2005/0263294 | A1 | 12/2005 | Braddick | |

(Continued)

OTHER PUBLICATIONS

International Search Report and Written Opinion issued by the Korean Intellectual Property Office regarding International Application No. PCT/US2013/073220, dated Sep. 3, 2014, 11 pages.

(Continued)

*Primary Examiner* — Giovanna C Wright
(74) *Attorney, Agent, or Firm* — Haynes and Boone, LLP

(57) ABSTRACT

A liner installation system for use in a wellbore having a casing string disposed therein. The system includes a liner string having a liner hanger and a liner top and a setting tool having an expansion cone assembly and a locator cylinder. After running the liner string through the casing string such that at least the liner hanger is positioned within the wellbore casing, the setting tool is run through the casing string until the locator cylinder contacts the liner top. Thereafter, axially moving the expansion cone assembly through the liner string radially expands the liner hanger into contact with the casing string.

20 Claims, 7 Drawing Sheets

(56) References Cited

U.S. PATENT DOCUMENTS

| | | | | |
|---|---|---|---|---|
| 2006/0065408 | A1* | 3/2006 | Green | B21D 17/04 166/384 |
| 2009/0200041 | A1 | 8/2009 | Watson | |
| 2011/0132622 | A1 | 6/2011 | Moeller et al. | |
| 2013/0299169 | A1* | 11/2013 | Rex | E21B 33/14 166/285 |

OTHER PUBLICATIONS

Patent Examination Report No. 1, issued by IP Australia regarding Australian Patent Application No. 2013406742, dated Jul. 21, 2016, 5 pages.

Patent Examination Report No. 2, issued by IP Australia regarding Australian Patent Application No. 2013406742, dated Nov. 21, 2016, 3 pages.

* cited by examiner 40
106
142
104
106
140
106
102
106
120
122
106
108
124
100

40
112
142
104
140
102
106
120
122
106
124
100

40
112
142
104
140
102
192
190
188
120
106
186
106
122
124
100

LINER HANGER SETTING TOOL AND METHOD FOR USE OF SAME

TECHNICAL FIELD OF THE DISCLOSURE

This disclosure relates, in general, to equipment utilized in conjunction with operations performed in relation to subterranean wells and, in particular, to a liner hanger setting tool for installing a prepositioned liner string within a casing string in a subterranean wellbore.

BACKGROUND

Without limiting the scope of the present invention, its background is described with reference to constructing a subterranean well, as an example.

In conventional practice, the drilling of an oil or gas well involves creating a wellbore that traverses numerous subterranean formations. For a variety reasons, each of the formations through which the well passes is preferably sealed. For example, it is important to avoid an undesirable passage of formation fluids, gases or materials from the formations into the wellbore or for wellbore fluids to enter the formations. In addition, it is commonly desired to isolate producing formations from one another and from nonproducing formations.

Accordingly, conventional well architecture typically includes the installation of casing within the wellbore. In addition to providing the sealing function, the casing also provides wellbore stability to counteract the geomechanics of the formation such as compaction forces, seismic forces and tectonic forces, thereby preventing the collapse of the wellbore wall. The casing is generally fixed within the wellbore by a cement layer that fills the annulus between the outer surface of the casing and the wall of the wellbore. For example, once a casing string is located in its desired position in the well, a cement slurry is pumped via the interior of the casing, around the lower end of the casing and upward into the annulus. After the annulus around the casing is sufficiently filled with the cement slurry, the cement slurry is allowed to harden, thereby supporting the casing and forming a substantially impermeable barrier.

In standard practice, the wellbore is drilled in intervals with casing installed in each interval before the next interval is drilled. As such, each succeeding casing string placed in the wellbore typically has an outside diameter having a reduced size when compared to the previously installed casing string. Specifically, a casing to be installed in a lower wellbore interval must be passed through the previously installed casing strings in the upper wellbore intervals. In one approach, each casing string extends downhole from the surface such that only a lower section of each casing string is adjacent to the wellbore wall. Alternatively, the wellbore casing strings may include one or more liner strings, which do not extend to the surface of the wellbore, but instead typically extend from near the bottom end of a previously installed casing downward into the uncased portion of the wellbore. In such installations, the liner string may be set or suspended from a liner hanger positioned near the uphole end of the liner string.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
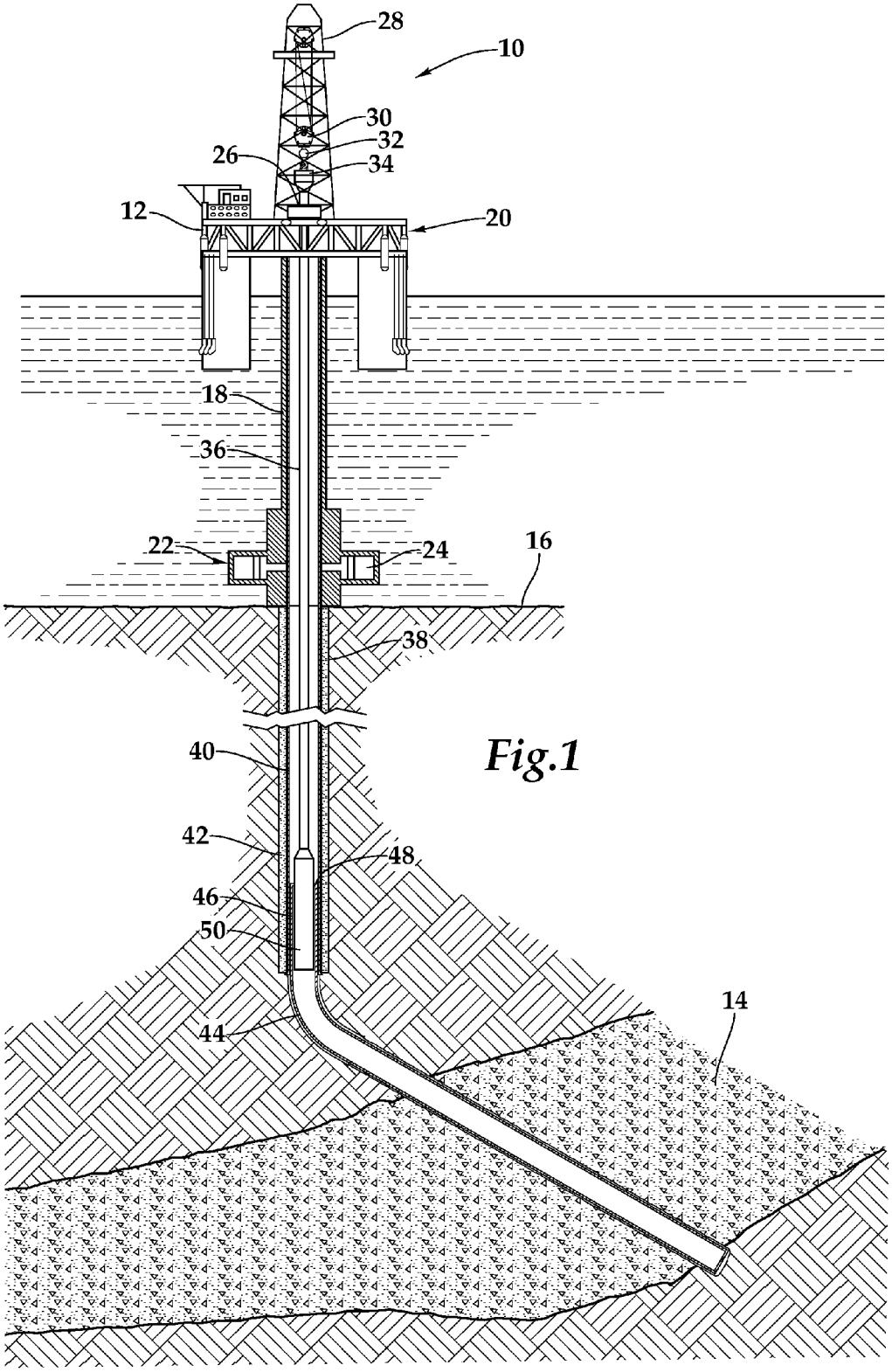
FIG. 1 is a schematic illustration of an offshore oil and gas platform during installation of a liner string in a subterranean wellbore according to an embodiment of the present disclosure.
Figure 2A:
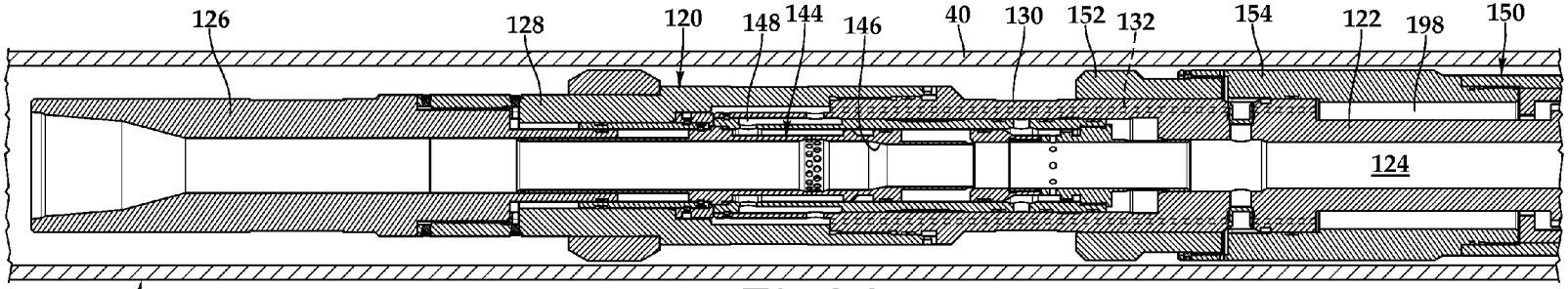
FIGS. 2A-2E are cross sectional views of successive axial sections of a liner hanger setting tool being run in a subterranean wellbore prior to being stabbed into a liner string according to an embodiment of the present disclosure.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

In a first aspect, the present disclosure is directed to a method for installing a liner string in a casing string disposed within a wellbore. The method includes positioning the liner string in the wellbore, the liner string including a liner hanger and a liner top; running the liner string through the casing string such that at least the liner hanger is positioned within the wellbore casing; after running the liner string through the casing string, positioning a setting tool in the wellbore, the setting tool having an expansion cone assembly and a locator cylinder; running the setting tool through the casing string; contacting the liner top with the locator cylinder; axially moving the expansion cone assembly through the liner string to radially expand the liner hanger into contact with the casing string; and retrieving the setting tool out of the wellbore.

The method may also include anchoring the setting tool within the liner string before axially moving the expansion cone assembly through the liner string; mechanically actuating an anchor assembly operably associated with the setting tool; hydraulically actuating an anchor assembly operably associated with the setting tool; hydraulically shifting a piston operably associated with the expansion cone relative to the locator cylinder; defining full travel of the expansion cone assembly by exposing at least one bypass port extending through the locator cylinder to an operating fluid that hydraulically shifts the piston; axially moving the expansion cone assembly through the liner string for primary expansion of the liner hanger; axially moving the expansion cone assembly through the liner string for re-expansion of the liner hanger; cementing at least a portion of the liner string from the liner top down before positioning the setting tool in the wellbore and/or anchoring and sealing the liner hanger within the casing string.

In a second aspect, the present disclosure is directed to a liner installation system for use in a wellbore having a casing string disposed therein. The system includes a liner string having a liner hanger and a liner top and a setting tool having an expansion cone assembly and a locator cylinder. After running the liner string through the casing string such that at least the liner hanger is positioned within the casing string, the setting tool is run through the casing string until the locator cylinder contacts the liner top. Thereafter, axially moving the expansion cone assembly through the liner string radially expands the liner hanger into contact with the casing string.

In some embodiments, the setting tool may include an anchor assembly operable to anchor the setting tool within the liner string before axially moving the expansion cone assembly through the liner string. In these embodiments, the anchor assembly may be a mechanically actuating anchor assembly, a hydraulically actuating anchor assembly or the like. In certain embodiments, the expansion cone assembly may include a piston operable for axial movement relative to the locator cylinder responsive to hydraulic pressure. In various embodiments, the locator cylinder may include at least one bypass port operable to define full travel of the expansion cone assembly when the bypass port is exposed to the hydraulic pressure. In one embodiment, the radial expansion of the liner hanger into contact with the casing string may be primary expansion of the liner hanger. In another embodiment, the radial expansion of the liner hanger into contact with the casing string may be re-expansion of the liner hanger. In certain embodiments, cement may be positioned between the liner string and the casing string from the liner top down prior to the setting tool being run through the casing string. In particular embodiments, the radial expansion of the liner hanger into contact with the casing string may result in anchoring and sealing the liner hanger within the casing string.

Referring initially to FIG. 1, a setting tool for installing a liner string in a subterranean wellbore is being deployed from an offshore oil or gas platform that is schematically illustrated and generally designated 10. A semi-submersible platform 12 is centered over a submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a work string 36.

A wellbore 38 has been drilled in sections through the various earth strata including formation 14. A casing string 40 is secured within an upper portion of wellbore 38 by cement 42. The term "casing" is used herein to designate a tubular string operable to be positioned in a wellbore to provide wellbore stability. The casing may be of the type known to those skilled in the art as a "liner" and may be made of any material, such as steel or a composite material. The casing may be a jointed tubular string or a continuous tubular string. Extending downhole from casing string 40 into a lower portion of wellbore 38 is a liner string 44 that includes at its upper end, a liner hanger 46 and a liner top 48. In the illustrated embodiment, liner string 44 was previously positioned in wellbore 38 but was not installed or not fully installed within casing string 40. For example, liner string 44 may have been run downhole on a convention running tool including a setting assembly but for some reason, the operation or a failure in the operation of the setting assembly did not successfully set liner hanger 46 such that the desired anchor load and/or seal was not established. Alternatively, liner string 44 may have been run downhole on a running tool without a setting assembly such that, for example, a top squeeze cement operation may be performed. Regardless of the reason liner hanger 46 for not fully installed, a setting tool 50 has subsequently been run downhole on work string 36. Once setting tool 50 has suitably contacted liner top 48, axial movement of an expansion cone assembly of setting tool 50 is operable to radially expand liner hanger 46 into contact with casing string 40 preferably anchoring and sealing liner hanger 46 within casing string 40. Thereafter, setting tool 50 may be retrieved from wellbore 38. In the case wherein a previous setting operation failed, the operation of setting tool 50 may be considered as a re-expansion operation of liner hanger 46. In the case wherein no previous setting operation was attempted, the operation of setting tool 50 may be considered as a primary expansion operation of liner hanger 46.

Even though FIG. 1 depicts a liner string being installed in a slanted wellbore, it should be understood by those skilled in the art that the present system is equally well suited for use in wellbores having other orientations including vertical wellbores, horizontal wellbores, deviated wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the present system is equally well suited for use in onshore operations.

Figure 2B:
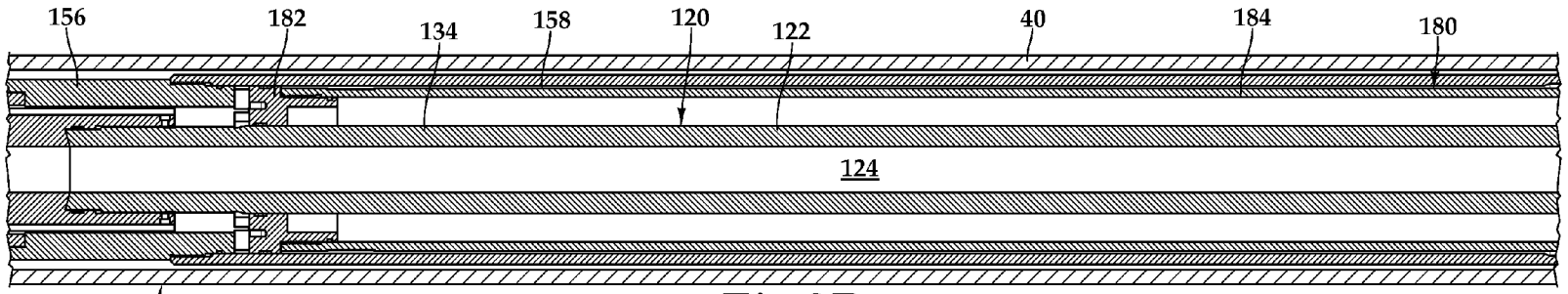
Figure 2C:
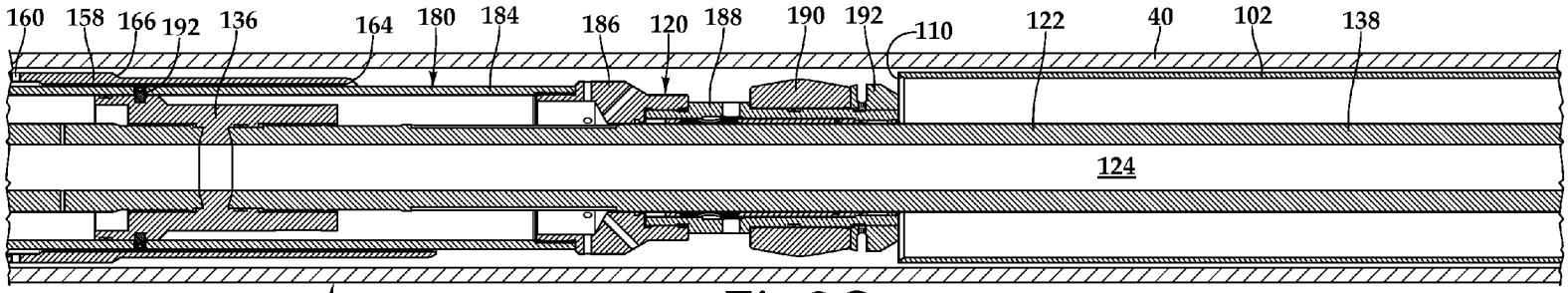
Figures 2D, 3D, 4D:
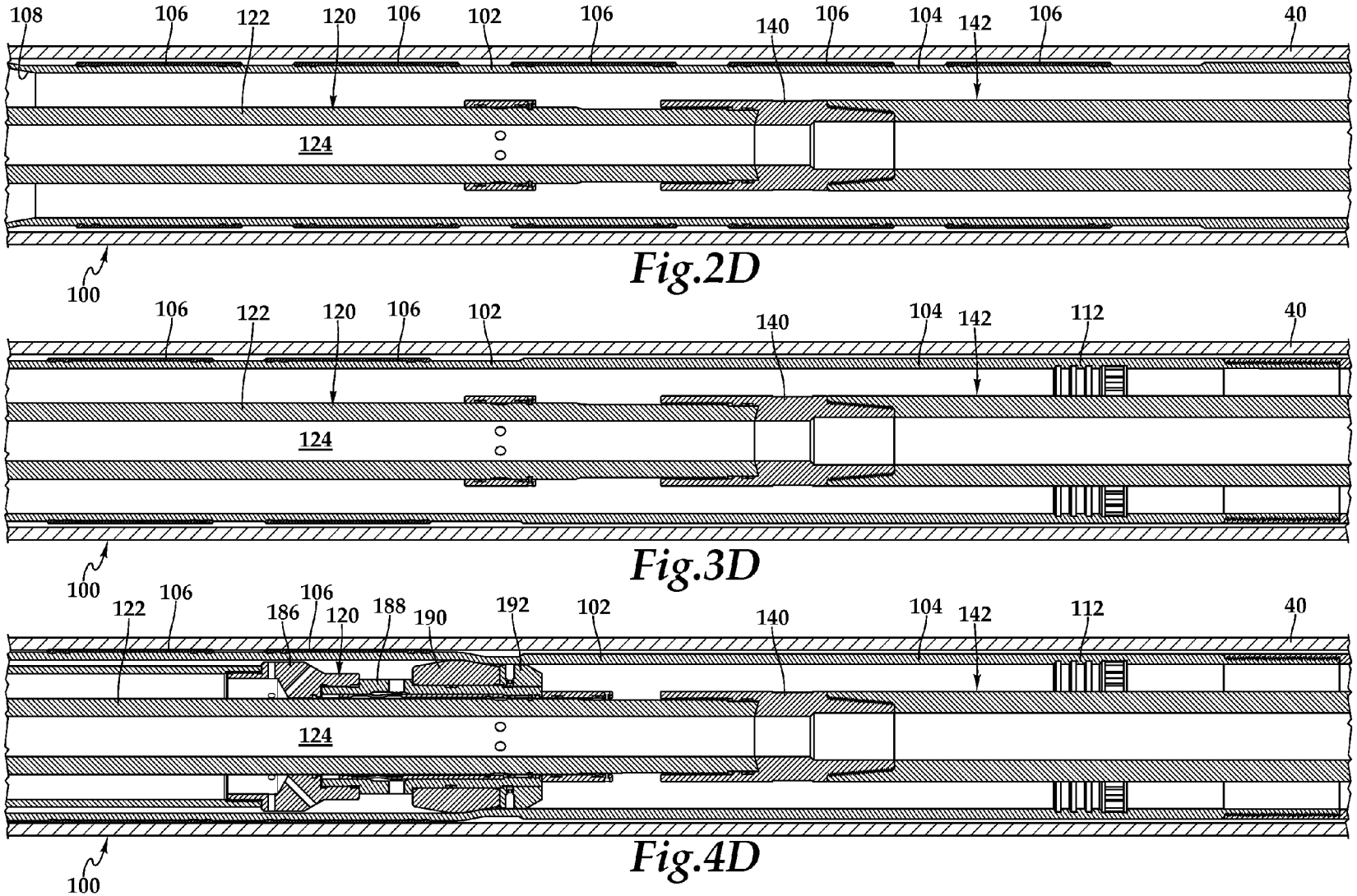
Figure 2E:
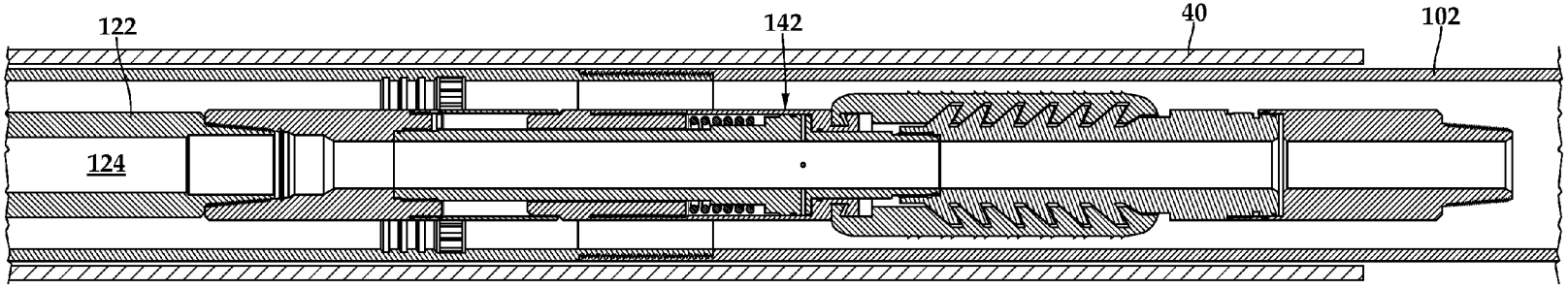

Referring next to FIGS. 2A-2E, therein is depicted a well system including a liner hanger setting tool positioned in a casing string having a liner string disposed therein that is generally designated 100. As best seen in FIGS. 2C-2D, a liner string 102 has been previously positioned but not set in casing string 40. Liner string 102 may include any number of substantially tubular sections that are preferably formed from jointed tubulars that are threadably coupled together. In the illustrated section, liner string 102 includes a liner hanger 104 having a plurality of resilient elements depicted as rubbers elements 106 that are operable to engage an inner surface of casing string 40 to establish a sealing and anchoring relationship therewith upon expansion of liner hanger 104. Liner hanger 104 includes a cone receiver 108 and a liner top 110. Liner hanger 104 may also include other elements such as a latch profile 112 operable to engage or receive mating tools therein.

Disposed within casing string 40 and partially within liner string 102 is liner hanger setting tool 120. Setting tool 120 includes a plurality of substantially tubular members that may be referred to as a tubular mandrel subassembly 122 that cooperate together to form a central bore 124 extending throughout. Tubular mandrel subassembly 122 includes an upper body 126 that may be threadably and sealingly coupled to other components of the work string at its upper end. Upper body 126 is threadably coupled to an upper mandrel assembly 128 that is threadably coupled to a cross over mandrel assembly 130 that includes one or more fluid passageways 132 that are depicted in dashed lines as they are not in illustrated cross section. At its lower end, cross over mandrel assembly 130 is threadably coupled to an intermediate mandrel assembly 134. A mandrel coupling 136 threadably connects intermediate mandrel assembly 134 to lower mandrel assembly 138. Lower mandrel assembly 138 is threadably coupled to a lower body 140 that may be threadably and sealingly coupled to other components of the work string at its lower end such as anchor assembly 142.

Figure 5:
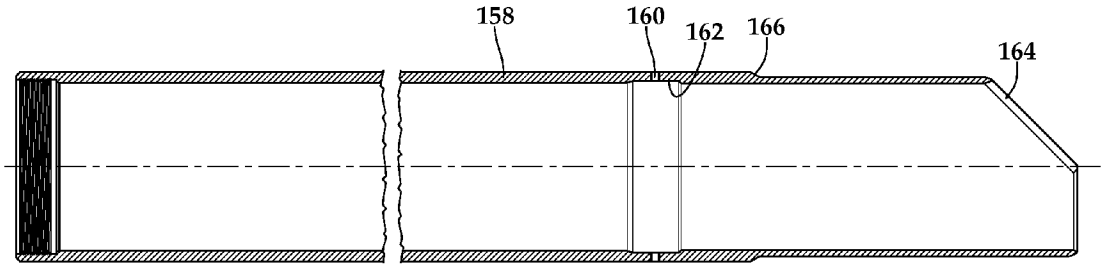
FIG. 5 is a cross sectional view of a locator cylinder for use in a liner hanger setting tool according to an embodiment of the present disclosure.

Positioned generally between upper mandrel assembly 128 and cross over mandrel assembly 130 is a hydraulic communication assembly 144 that includes a ball seat 146 and a fluid pathway 148 that is in fluid communication with fluid passageways 132 of cross over mandrel assembly 130. Setting tool 120 includes a plurality of substantially tubular members that may be referred to as a tubular housing subassembly 150. Housing subassembly 150 includes an upper housing assembly 152 that is threadably coupled to an intermediate housing assembly 154 that in turn is threadably coupled to a lower housing assembly 156. Lower housing assembly 156 is threadably coupled to a locator cylinder 158. As best seen in FIG. 5, locator cylinder 158 includes a plurality of bypass ports 160 disposed about a radially reduced section 162 of locator cylinder 158. In addition, locator cylinder 158 includes a tapered nose 164 that aids in passage of setting tool 120 through wellbore restrictions such as liner top 110 through rotation of setting tool 120 upon reaching such restrictions. Locator cylinder 158 also includes a shoulder 166 that may operate as a no-go on liner top 110.

Figure 3A:
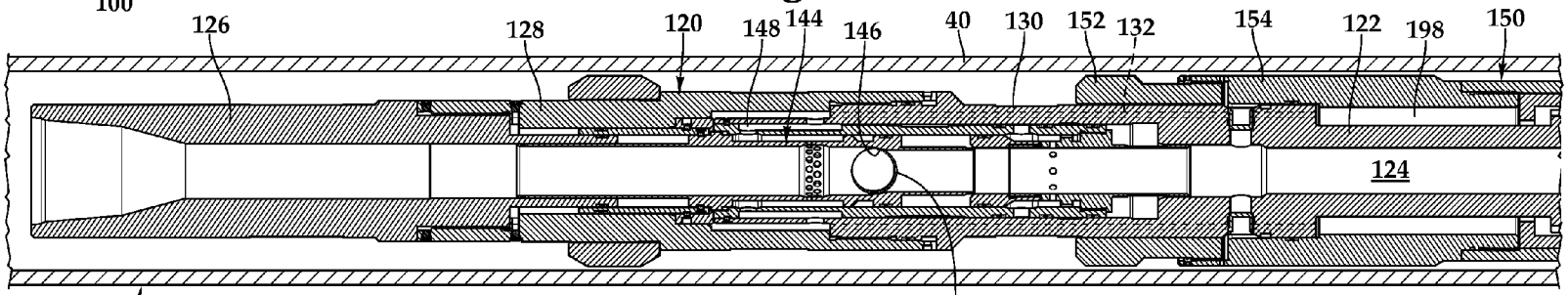
FIGS. 3A-3E are cross sectional views of successive axial sections of a liner hanger setting tool being located on a liner top of a liner hanger in a subterranean wellbore according to an embodiment of the present disclosure.
Figure 4A:
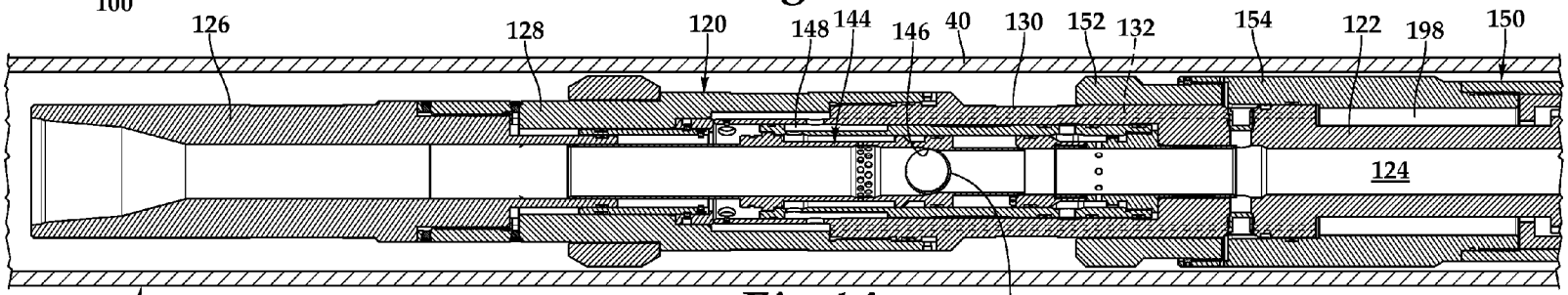
FIGS. 4A-4E are cross sectional views of successive axial sections of a liner hanger setting tool after expansion of a liner hanger in a subterranean wellbore according to an embodiment of the present disclosure.
Figure 3B:
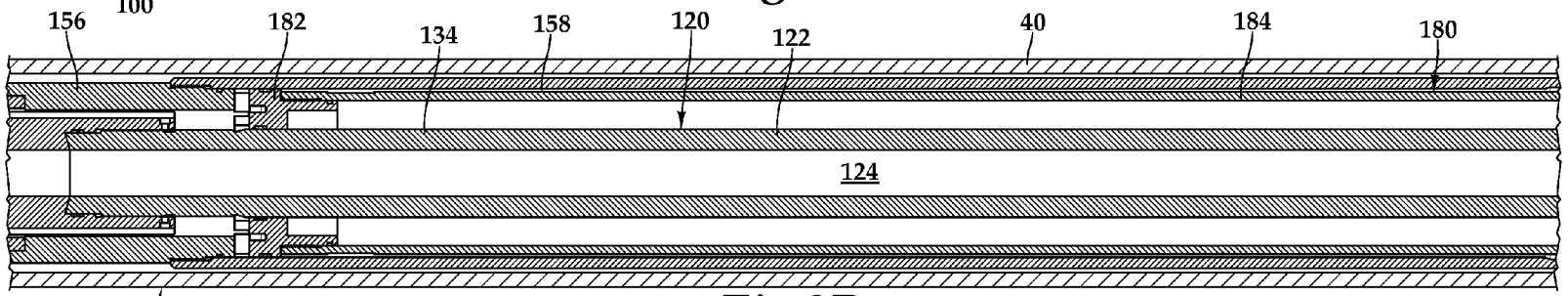
Figure 4B:
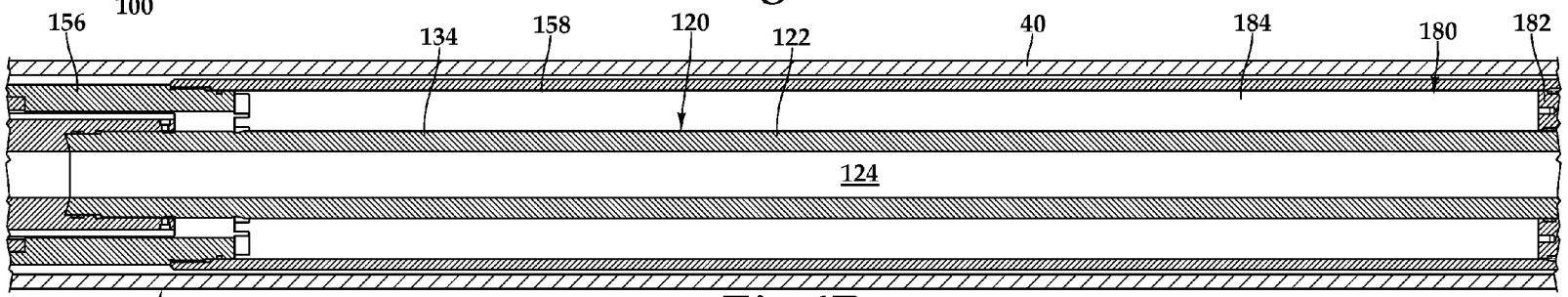
Figure 3C:
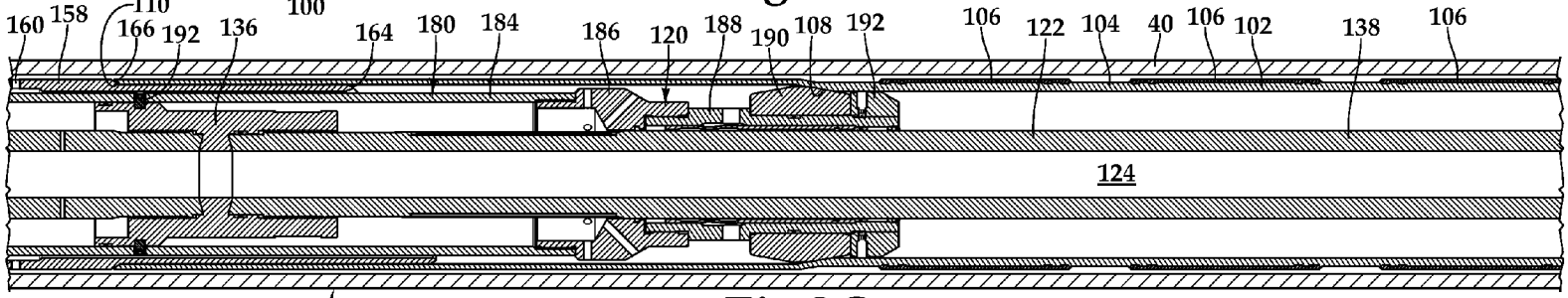

Setting tool 120 has an expansion cone assembly 180 that includes a piston 182 that is slidably and sealingly received between intermediate mandrel assembly 134 and locator cylinder 158. Expansion cone assembly 180 also includes a drive sleeve 184, a support ring 186, a support sleeve 188, an expansion cone 190 and a shoe 192. Expansion cone 190 has a frustoconical shape having a smallest outer diameter that is smaller than the inner diameter of liner hanger 104 and a largest outer diameter that is larger than the inner diameter of liner hanger 104. Expansion cone 190 may be received in cone receiver 108 of liner hanger 104, where the inner diameter of liner hanger 104 is large enough to accept expansion cone 190 without having been radially expanded, as best seen in FIG. 3C. Drive sleeve 184 is initially secured to mandrel coupling 136 by one or more frangible members depicted as shear screws 192.

Figure 6A:
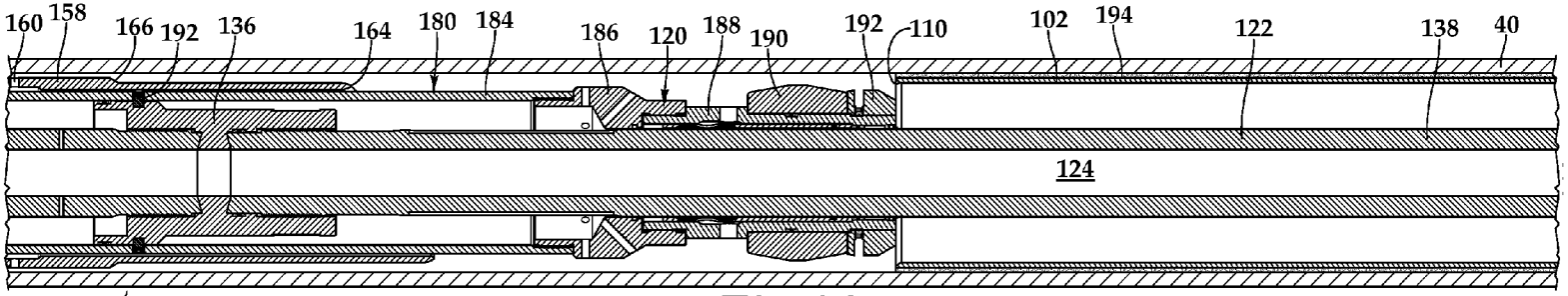
FIGS. 6A-6B are cross sectional views of successive axial sections of a liner hanger setting tool being run in a subterranean wellbore prior to being stabbed into a liner string after a top squeeze cement operation according to an embodiment of the present disclosure.
Figure 6B:
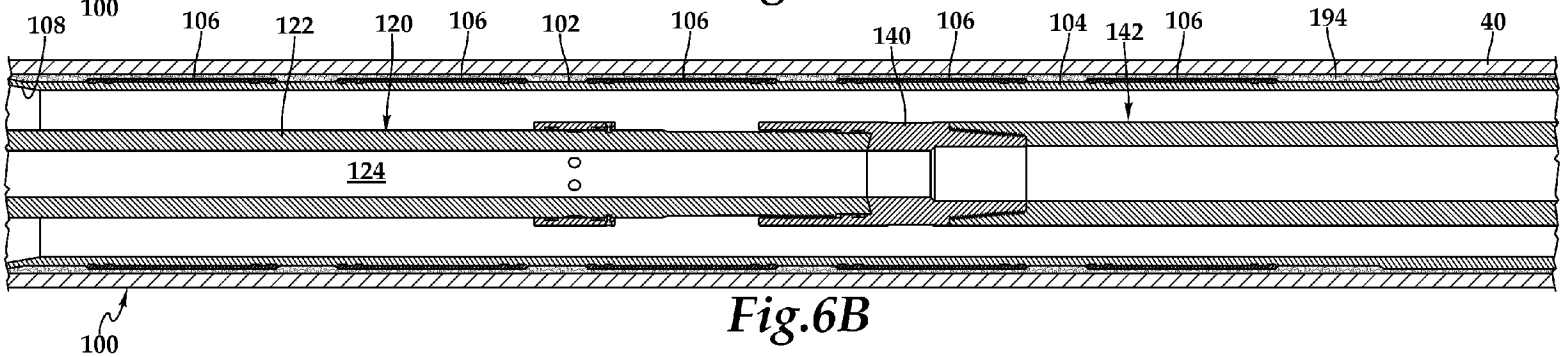

In operation and additionally referencing FIGS. 3A-3E and 4A-4E, setting tool 120 is used to install liner string 102 in casing string 40. In the illustrated embodiment, liner string 102 has been prepositioned in casing string 40 on a previous run into the wellbore such that liner hanger 106 is disposed within a lower portion of casing string 40. For example, it may be desirable to prepositioned liner string 102 in casing string 40 to allow a top squeeze cement operation to place cement 194 between liner string 102 and casing 40, as best seen in FIGS. 6A-6B. Alternatively, liner string 102 may be prepositioned in casing string 40 due to a failure in a convention running and setting operation associated with liner string 102. In any event, setting tool 120 may be run in the wellbore on a work string 36 or other conveyance following the prepositioned liner string 102 in casing string 40. While tripping into the wellbore, tapered nose 164 of locator cylinder 158 aids in passage of setting tool 120 through wellbore restrictions including liner top 110 by rotating setting tool 120 upon reaching such restrictions. As best seen in comparing FIGS. 2C and 3C, as setting tool 120 enters liner string 102, a tight clearance exists between liner top 110 and locator cylinder 158. Tapered nose 164 enables proper alignment and locating of setting tool 120 within liner string 102 enabling insertion of setting tool 120 within liner string 102 until shoulder 166 contacts liner top 110, as best seen in FIG. 3C.

Figure 3E:
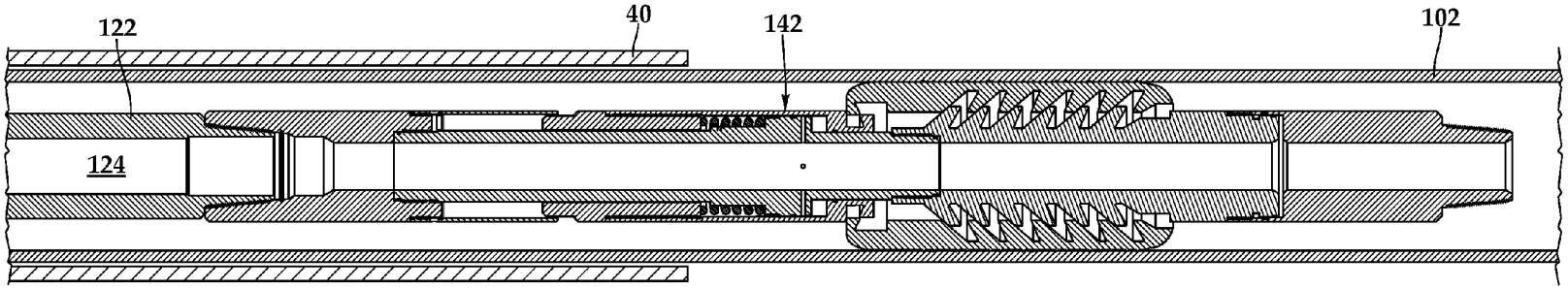
Figure 4E:
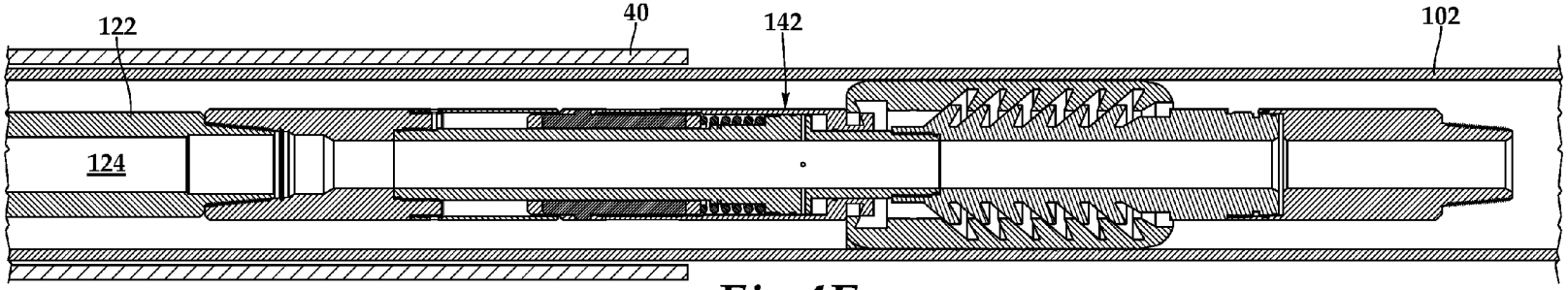

Once setting tool 120 is suitable located within liner string 102, anchor assembly 142 may be set hydraulically by pressurizing the fluid within interior passageway 124, mechanically by, for example, rotation of work string 36, or by other means to secure setting tool 120 within liner string 102, as best seen in FIG. 3E. A plug element depicted as ball 196 may be deployed into the wellbore to enable hydraulic operation of setting tool 120 and particularly expansion cone assembly 180. As best seen in FIG. 3A, once ball 196 engages ball seat 146, fluid communication is established between interior passageway 124 and fluid passageways 132 of cross over mandrel assembly 130 via fluid pathway 148 of hydraulic communication assembly 144. In this configuration, fluid pressure from the surface may be applied to interior passageway 124 of setting tool 120 via work string 36. With ball 196 blocking interior passageway 124, the fluid pressure enters fluid pathway 148 of hydraulic communication assembly 144 and is directed to fluid passageways 132 of cross over mandrel assembly 130. The fluid pressure then enters chamber 198 between mandrel subassembly 122 and housing subassembly 150 before acting on an upper surface of piston 182. Initially, the downhole force generated by the fluid pressure acting on piston 182 is counteracted by shear screws 192 that secure drive sleeve 184 to mandrel coupling 136. When sufficient force is generated by the fluid pressure acting on piston 182, however, shear screws 192 are broken, allowing relative movement between expansion cone assembly 180 and mandrel subassembly 122.

Figure 4C:
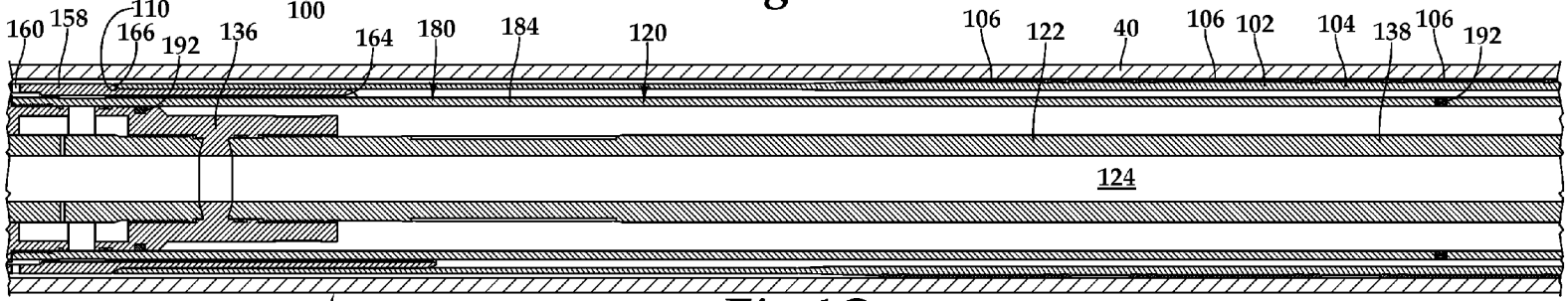

To expand liner hanger 104, expansion cone assembly 180 is driven downhole by the fluid pressure acting on piston 182 such that expansion cone 190 travels through liner hanger 104 to radially expand and plastically deform liner hanger 104. In certain instances, expansion cone 190 may be sized to radially expand and plastically deform liner hanger 104 such that the outer diameter of liner hanger 104 is pressed into gripping and sealing engagement with casing string 40, as best seen in FIGS. 4C-4D. In the illustrated embodiment, liner hanger 104 includes a plurality of circumferential seals 106 that facilitate the gripping and sealing engagement with casing string 40. Downhole travel of expansion cone assembly 180 and expansion cone 190 ceases when piston 182 sufficiently enters radially reduced section 162 of locator cylinder 158 such that bypass ports 160 are exposed to the pressure within interior passageway 124. In this configuration, the pressure enters the annulus between setting tool 120 and casing string 40 and travels to the surface to provide a signal that the setting of liner hanger 104 was successful. Once expansion cone 190 completes it travel through liner hanger 104 and radially expands liner hanger 104 into the desired gripping and sealing engagement with casing string 40, setting tool 120 may be disengaged from liner string 102 by applying load and/or torque via work string 36 to release anchor assembly 142. Thereafter, setting tool 120 may be retrieved to the surface with work string 36.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A method for installing a liner string in a casing string disposed within a wellbore, the method comprising:

positioning the liner string in the wellbore, the liner string including a liner hanger and a liner top;

running the liner string through the casing string such that at least the liner hanger is positioned within the casing string;

after running the liner string through the casing string, positioning a setting tool in the wellbore, the setting tool having an expansion cone assembly and a locator cylinder;

running the setting tool through the casing string;

contacting the liner top with the locator cylinder;

axially moving the expansion cone assembly through the liner string to radially expand the liner hanger into contact with the casing string; and retrieving the setting tool out of the wellbore, wherein, during the axial movement of the expansion cone through the liner string to radially expand the liner hanger into contact with the casing string, the locator cylinder remains in contact with the liner top.

2. The method as recited in claim 1 further comprising anchoring the setting tool within the liner string before axially moving the expansion cone assembly through the liner string.

3. The method as recited in claim 2 wherein anchoring the setting tool within the liner string further comprises mechanically actuating an anchor assembly operably associated with the setting tool.

4. The method as recited in claim 2 wherein anchoring the setting tool within the liner string further comprises hydraulically actuating an anchor assembly operably associated with the setting tool.

5. The method as recited in claim 1 wherein axially moving the expansion cone assembly through the liner string further comprises hydraulically shifting a piston operably associated with the expansion cone relative to the locator cylinder.

6. The method as recited in claim 5 further comprising defining full travel of the expansion cone assembly by exposing at least one bypass port extending through the locator cylinder to an operating fluid that hydraulically shifts the piston.

7. The method as recited in claim 1 wherein axially moving the expansion cone assembly through the liner string to radially expand the liner hanger into contact with the casing string further comprises primary expansion of the liner hanger.

8. The method as recited in claim 1 wherein axially moving the expansion cone assembly through the liner string to radially expand the liner hanger into contact with the casing string further comprises re-expansion of the liner hanger.

9. The method as recited in claim 1 further comprising cementing at least a portion of the liner string from the liner top down before positioning the setting tool in the wellbore.

10. The method as recited in claim 1 wherein axially moving the expansion cone assembly through the liner string to radially expand the liner hanger into contact with the casing string further comprises anchoring and sealing the liner hanger within the casing string.

11. A liner installation system for use in a wellbore having a casing string disposed therein, the system comprising:

a liner string having a liner hanger and a liner top, wherein the liner string is run through the casing string such that at least the liner hanger is positioned within the casing string; and a setting tool having an expansion cone assembly and a locator cylinder, wherein, after running the liner string through the casing string such that at least the liner hanger is positioned within the casing string, the setting tool is run through the casing string until the locator cylinder contacts the liner top;

wherein the expansion cone assembly is axially moved through the liner string to radially expand the liner hanger into contact with the casing string; and wherein, during the axial movement of the expansion cone through the liner string to radially expand the liner hanger into contact with the casing string, the locator cylinder remains in contact with the liner top.

12. The system as recited in claim 11 wherein the setting tool further comprising an anchor assembly operable to anchor the setting tool within the liner string before axially moving the expansion cone assembly through the liner string.

13. The system as recited in claim 12 wherein the anchor assembly further comprises a mechanically actuating anchor assembly.

14. The system as recited in claim 12 wherein the anchor assembly further comprises a hydraulically actuating anchor assembly.

15. The system as recited in claim 11 wherein the expansion cone assembly further comprises a piston operable for axial movement relative to the locator cylinder responsive to hydraulic pressure.

16. The system as recited in claim 15 wherein the locator cylinder further comprises at least one bypass port operable to define full travel of the expansion cone assembly when the bypass port is exposed to the hydraulic pressure.

17. The system as recited in claim 11 wherein the radial expansion of the liner hanger into contact with the casing string further comprises primary expansion of the liner hanger.

18. The system as recited in claim 11 wherein the radial expansion of the liner hanger into contact with the casing string further comprises re-expansion of the liner hanger.

19. The system as recited in claim 11 further comprising cement positioned between the liner string and the casing string from the liner top down prior to the setting tool being run through the casing string.

20. The system as recited in claim 11 wherein the radial expansion of the liner hanger into contact with the casing string further comprises anchoring and sealing the liner hanger within the casing string.

* * * * *